US006802908B2

(12) United States Patent
Zachhuber

(10) Patent No.: US 6,802,908 B2
(45) Date of Patent: Oct. 12, 2004

(54) PROCEDURE AND DEVICE FOR CLEANING FLOORS WITH FLAT CLEANING MOPS

(75) Inventor: Kurt Zachhuber, Bedford, NH (US)

(73) Assignee: Amking Technologies, Bedford, NH (US)

( * ) Notice: Subject to any disclaimer, the term of this patent is extended or adjusted under 35 U.S.C. 154(b) by 0 days.

(21) Appl. No.: 10/229,501

(22) Filed: Aug. 28, 2002

(65) Prior Publication Data

US 2004/0040574 A1 Mar. 4, 2004

(51) Int. Cl.[7] ..... B08B 7/00

(52) U.S. Cl. ..... 134/6; 134/18; 134/95.3; 134/172; 134/177; 134/198; 134/201

(58) Field of Search ..... 134/6, 18, 95.3, 134/172, 177, 198, 201

(56) References Cited

U.S. PATENT DOCUMENTS 4,174,977 A * 11/1979 Shallenberg et al. ..... 134/6
5,058,738 A * 10/1991 Svensson ..... 206/229
2002/0175092 A1 * 11/2002 Stulens et al. ..... 206/229

* cited by examiner

*Primary Examiner*—Zeinab El-Arini
(74) *Attorney, Agent, or Firm*—Katten Muchin; Zavis Rosenman

(57) ABSTRACT

In a procedure for cleaning floors by hand with the help of flat cleaning mops, mops provided with a certain quantity of cleaning solution are used. In this case, at least one mop is removed from a storage container (1), and saturated with solution before or during removal; the solution is applied onto the surface of the mop; the mops are stored as is after use in a holding container (2) up to their disposal for purposes of regeneration. A device for fitting and preparing a larger number of flat cleaning mops consists of a storage container, which has a removal opening (5) for removing mops, and is provided inside with a feeding device (11) for prior saturating the removed mops with cleaning solution.

24 Claims, 1 Drawing Sheet

23
18
17
11
1
20
18
16
19
22
12
5
2
9
21
22
6
7
3
8
4
10
24
13
14
15

PROCEDURE AND DEVICE FOR CLEANING FLOORS WITH FLAT CLEANING MOPS

The invention relates to a procedure for cleaning floors by hand with the help of flat cleaning mops, wherein mops provided with a certain quantity of cleaning solution are used.

This procedure is carried out on large surfaces by means of a device for supplying and preparing flat cleaning mops with a storage container, which stores a larger number of mops.

The use of flat cleaning mops, so called flat mops, in cleaning technology is very widespread. Flat mops are used in particular on floors that need to be cleaned by hand, e.g., in laboratories, hospitals, production facilities with high demands on purity and cleanliness, e.g., in computer technology, chip manufacture, medical technology, and the like.

Flat mops have the advantage of covering a large floor surface area, wherein the operator can easily check the result. One special advantage lies in the fact that the used flat mop need only be replaced by a fresh one at the latest when the cleaning solution applied to the fresh flat mop has been used up. The precondition for achieving a high standard of cleaning is that the operator does not have to rinse, wring and again saturate the flat mop, as is usually the case.

As a result, this invention proceeds from the knowledge that the mop replacement principle is to replace on-site mop cleaning, i.e., the used mop, whose cleaning solution has been used up, is replaced by a fresh mop saturated with fresh cleaning solution. The cleaning solution is to be applied to a fresh mop in the dosage needed for the desired cleaning result.

To ensure a suitable dosage, it is already known from EP 90850020 B1 to pack a cleaning mop in a sealed cover, which also encompasses a sealed container with cleaning solution, so that the liquid is separate from the mop, and the container can be opened without tearing open the cover, so that the liquid flows out inside the cover, and saturates the mop. After use, the mop is taken to the washing plant, where it is washed and packed in a new cover for reuse in the manner described.

Also known from U.S. Pat. No. 4,174,977 is to have a conventional cleaning cart with rinsing bucket, mop press and waste container incorporate a metering device, which makes it possible to saturate the mop rinsed and dry-pressed for reuse with a selectable quantity of fresh cleaning solution. Metering device operation is valve-controlled, wherein a settable quantity of cleaning solution is diverted from a storage container and applied by means of a swiveling dispensing tube onto the mop bundled in a bucket, which consists of a bundle of mop element skeins. This type of metering device is unsuitable for flat mops, since it cannot be used to achieve a uniform distribution of cleaning solution. In addition, bundled mops are less suitable for the reliable performance of cleaning jobs where high demands are placed on the cleaning result.

By contrast, the object of this invention is to create a procedure and device of the kind mentioned at the outset for cleaning floor surfaces that not only satisfy the highest demands on cleaning quality; in particular, the goal is to support an environment-friendly, cost-effective cleaning procedure with a suitable device that does not require renewed on-site preparation of the cleaning mop.

This object is achieved in the procedure according to the invention in that at least one mop is removed from a storage container, that the mops are saturated with solution before or during removal, that the solution is applied onto the surface of the mop, and that the mops are kept as is after use in a holding container until disposed of for purposes of their regeneration.

This procedure can be advantageously supported by means of a suitable device for fitting and preparing flat cleaning mops with a storage container, which stores a larger number of mops, has a removal opening for removing mops, and is provided inside with a feeding device for prior saturating the removed mops with cleaning solution.

In addition to at least one storage container, this device advantageously encompasses at least one holding container, which accommodates the dirty mops following their use.

The procedure and device according to the invention provide, as it were, a novel way for mastering cleaning jobs involving large surfaces, e.g., of the kind handled in particular by large companies in the cleaning industry, and for which the solution proposed by the invention is therefore of special interest. Because the device according to the invention makes it possible to automatically control how much cleaning solution is metered per mop, requirements for an elevated cleaning quality can be harmonized in an ideal fashion with those for an economical utilization of resources. A suitable metering of cleaning solution makes it possible to adjust the quantity of cleaning solution applied per unit area of the floor surface to be cleaned in a highly reliable and accurate manner; at the same time, this sets the consumption of fresh water and cleansing agent. In comparison to the conventional, individual metering based on cleaning power, an economical use of cleaning agent can therefore also be generally achieved. The fact that the used mops are not washed on-site, but instead collected and washed in a large number at a washing plant, eliminates additional problems involving the disposal of dirty water. This means that fresh water is not used at the cleaning site, and nor must dirty water be removed. Therefore, an economic cost calculation can advantageously be based either on the cleaned surface or number of used mops. This makes it possible to calculate very precisely the financial burden placed on the customer for the "cleaning" service while still ensuring cleaning quality.

The cleaning system proposed by the invention, which is based on the use of flat mops and their exchange, is particularly suitable for use in franchise systems, which are suitably organized to perform cleaning services on-site and maintain a system for supplying fresh flat mops and disposing of dirty flat mops. This activity centers around the device according to the invention, which the franchise sets up in the number required at the customer, and there fits it with fresh flat mops, whose metering device must be serviced accordingly, and which can have a holding container for keeping the used mops, whose contents must be disposed of.

The mops are advantageously fanned out and stacked one on top of the other in a storage container of the device according to the invention. In this case, either only the mop removed from the stack, e.g., the top mop, is saturated with solution, wherein the remaining stack remains essentially dry, or several mops are moistened simultaneously, if used simultaneously or in rapid succession.

The mops are advantageously saturated with cleaning solution by spraying the mops with the solution until saturated. As an alternative, the mops can be saturated through immersion in a corresponding bath with cleaning solution.

For saturation purposes, the mops are removed from the stack of fresh flat mops in the storage container, preferably from the top, by first saturating the uppermost or lowermost mop of the stack with cleaning solution and then removing it. Another possibility is to remove the respective top mop of the stack and only then saturating it with solution in the direction taken off behind the stack. In this variant, the stack remains completely dry. Saturation can either take place by spraying immediately before removal, or drawing the mop through a bath filled with solution. To ensure a uniform saturation of the mop, it makes sense for the removal of the mop from the storage container to be automatically controlled.

The device according to the invention can be configured to have a metering device that routes an adjustable quantity of solution to the feeding device from a tank with fresh cleaning solution, which is advantageously designed as a spraying device.

Within the framework of the device according to the invention, the storage container has a magazine with a preferably horizontal cross section, which corresponds roughly to the dimensions of a fanned out mop, and whose height is dimensioned according to the stacking height of the number of fresh mops stacked one on top of the other therein. In this way, up to 50 or even up to 100 fresh mops can be stored in a dry state without any problem. Based on a cleaned floor surface per mop of 20 $m^2$, for example, this yields a savings of approx. $2.00 per liter of used cleaning solution in favor of the cleaning system according to the invention, calculated according to the statistical data valid in the U.S. In terms of the U.S. national economy, this denotes an overall savings of approx. 800 million dollars per year. These savings can essentially be attributed to the ability to precisely, and hence economically, meter the cleaning solution per mop, the surface coverage per mop depending on the cleaning job, and the rational maintenance, fitting and disposal of the device components according to the invention used in the process.

In another proposal according to the invention, the storage container has a removal opening in the front, under which is located the stack with fresh mops, and above which the feeding device is accommodated. In this case, it makes sense for an intermediate floor in the storage container to be adjustable in height based on the stack height, which diminishes as the mops stacked in the magazine are removed. The height of the intermediate floor can here be incrementally adjusted, wherein the height is adjusted by about the thickness of one mop in each increment.

In addition, actuation of the metering device can be linked with each height adjustment, so that the respectively removed mop or the uppermost mop of the stack is saturated with solution. As already stated above, this can either take place while the uppermost mop is still on the stack, or only after the uppermost mop has been taken off the stack.

Instead of a height-adjustable intermediate floor, the stack can rest on a fixed decking, wherein the removal opening adjusts to the stack height.

As concerns the structure of the storage container, the invention provides that the feeding device consists of spray nozzles distributed over the container cross section, which are connected to the metering device by a system of lines.

In one advantageous configuration of the metering device, the latter is situated with the tank for the cleaning solution and a compressed air bottle to convey the solution by means of compressed air to the feeding device in a separate casing.

Storage and holding containers are advantageously set up one next to the other on the casing for the metering device. The casing can be mounted on wheels, so that the operator can bring it along. This minimizes the time required to change out the mop.

For purposes of maintaining the device according to the invention, it makes sense that its storage and holding container each have a lid section that can be swing open to the side on hinges. Unlatching and tilting the lid makes it easy to both refill the storage container with fresh mops, and remove the dirty mops from the holding container.

In an advantageous form of execution of the invention, the magazine with stack of fresh flat mops is located inside the storage container, specifically above the intermediate floor, wherein the stack is bounded on the sides by vertical guide rods.

The height of the intermediate floor is advantageously adjusted by a spring force, exerted by the removal of the stack weight or through the use of an upper stop. Tension and/or compression springs that act on the intermediate floor are here used.

The storage container preferably has a drip floor below the stack for cleaning solution released to the sides of the stack, which can be returned for reuse. It makes sense to use a drain to connect the drip floor with a collecting basin provided in the lower part of the storage container.

In another advantageous configuration of the invention, the removal opening of the storage container is sealed form outside by means of a flap, which, when opened, actuates the metering device, whose subsequent actuation is disabled until the saturated mop has been removed. This ensures that the same mop cannot be moistened over and over again simply by opening the flap. The flap can also be provided with a lock, so that it additionally serves as a safety element when the device is not in use.

In order to reliably prevent already used mops given an empty magazine from again being taken from the holding container, the invention also provides that the holding container have a feed inlet on its lid section that is bridged to the inside by a deflection compartment, which prevents a hand from reaching in. The deflection compartment also enables a better utilization of space for the holding container.

BRIEF DESCRIPTION OF THE DRAWINGS

The invention shall now be described based on respective examples of the first and second embodiments of the invention.

DETAILED DESCRIPTION OF THE INVENTION

Figures 1, 2:
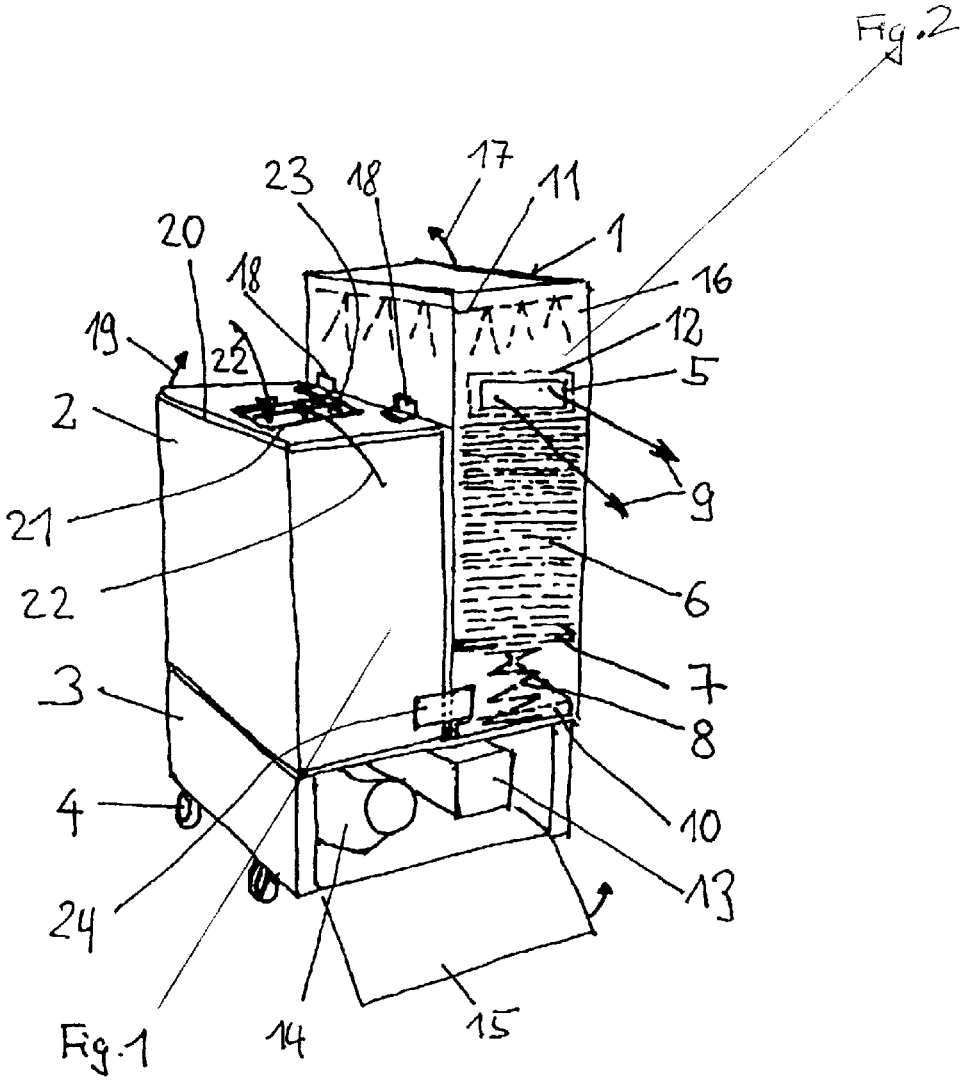

FIG. 1 shows a diagrammatic view of an exemplary device according to the first embodiment of the invention.

FIG. 2 shows a diagrammatic view of an exemplary device according to the second embodiment of the invention.

The tank 13 with the cleaning solution has a capacity of 301, for example. This is enough to saturate approx. 100 mops.

The storage container 1 contains a magazine preferably having 50 to 100 mops stacked one atop the other. The magazine is filled by swiveling open the lid 16 of the storage container 1 around the hinge 18 according to arrow 17.

The holding container 2 also has a lid section 20 that can be swiveled around the hinges 18 according to arrow 18, which accommodates the feed inlet 21. The dirty mops to be disposed of according to arrows 22 are laterally inserted into the holding container 2, passing by a deflection compartment 23, and then drop down into the holding container 2. The storage container 1 and holding container 2 are bonded together, and underneath with the casing 3, by means of bracket joints 24.

What is claimed is:

1. Procedure for cleaning floors by hand with the help of flat cleaning mops comprising the steps of providing a storage container having a plurality of flat cleaning mops fanned out and stacked one on top of the other in said storage container and providing a holding container attached to said storage container, wherein said mops are provided with a certain quantity of cleaning solution, wherein at least one mop is removed from said stack within said storage container during use, wherein a surface of only the mop removed from said stack is saturated with cleaning solution during removal from said storage container, wherein said removed mop is used to clean floors said and wherein the used mops are kept after use in holding container until disposed of for purposes of their regeneration.

2. Procedure according to claim 1, wherein an uppermost or lowermost mop of the stack is saturated with cleaning solution prior to being removed from said storage container.

3. Procedure according to claim 1, wherein an uppermost mop of the stack is taken off and saturated with cleaning solution in a direction taken off behind the stack.

4. Procedure according to claim 1, wherein the mops are saturated with a metered quantity of the cleaning solution.

5. Procedure according to claim 4, wherein the mops are saturated with the cleaning solution via spraying.

6. Procedure according to claim 1, wherein the storage and holding containers are safeguarded against unauthorized removals.

7. Procedure according to claim 1, wherein removal of the mops from the storage container is automatically controlled.

8. Device for storing and preparing flat cleaning mops for use in cleaning floors comprising a storage container for storing a plurality of flat cleaning mops used for cleaning, said storage container having a removal opening for removing mops stored within said storage container, a spray feeding device provided on the inside of said device for prior saturating the removed mops with a cleaning solution in preparation for use of said mops in cleaning, and a metering device that routes an adjustable quantity of the cleaning solution to the feeding device from a tank.

9. Device according to claim 8, further comprising a holding container for accommodating dirty mops after their use.

10. Device according to claim 8, wherein the metering device, the tank and a compressed air bottle are situated in a separate casing to convey the cleaning solution via compressed air to the feeding device.

11. Device according to claim 10, further comprising a holding container for accommodating dirty mops after their use, and wherein the storage and holding containers are set up one next to the other on the casing.

12. Device according to claim 11, wherein the casing can be moved on wheels.

13. Device according to claim 11, wherein the storage and holding containers each have a lid section that can be swung open on hinges.

14. Device according to claim 13, wherein the lid section of the holding container has a feed inlet bridged to the inside by a deflection compartment, which prevents a hand from reaching in.

15. Device according to claim 8, wherein the storage container has a magazine of stacked mops, said magazine having a horizontal cross section that corresponds to the dimensions of a fanned-out mop, and with a height that is dimensioned according to a stacking height of said plurality of mops stacked one on top of the other said magazine.

16. Device according to claim 15, wherein within said storage container, the stack of mops within said magazine is situated below, and the feeding device is situated above, relative to the removal opening.

17. Device according to claim 16, wherein the feeding device has spray nozzles distributed over the container cross section that are connected with the metering device.

18. Device according to claim 15, further comprising an intermediate floor carrying the stack of mops and situated in the storage container that can be adjusted in height based on the stack height, which intermediate floor height diminishes as the mops stacked in the magazine are removed.

19. Device according to claim 18, wherein the height of the intermediate floor can be incrementally adjusted by a thickness of one mop.

20. Device according to claim 19, wherein each height adjustment is linked with an actuation of the metering device so that a respectively removed mop or an uppermost mop of the stack is saturated with cleaning solution.

21. Device according to claim 19, wherein the magazine in the storage container consists of the intermediate floor and vertical guide rods bounding the stack of mops.

22. Device according to claim 18, wherein the height of the intermediate floor is adjusted by a spring force exerted by the removal of mops from the stack or through the use or an upper stop.

23. Device according to claim 15, wherein the storage container has a drip floor below the stack of mops for cleaning solution released to the sides of the stack.

24. Device according to claim 8, wherein the removal opening is sealed from outside by a flap, which, when opened, actuates the metering device, whose subsequent actuation is disabled until a saturated mop has been removed.

* * * * *